US012752956B2

(12) United States Patent
Dicocco et al.

(10) Patent No.: US 12,752,956 B2
(45) Date of Patent: Oct. 6, 2026

(54) FOOD CONTAINER

(71) Applicant: FRESHLINK PRODUCT DEVELOPMENT, LLC, Ridgefield Park, NJ (US)

(72) Inventors: Michael Dicocco, Sparta, NJ (US); Yi-Feng Tseng, Taipei City (TW); Dean Chapman, Montclair, NJ (US); Benjamin Broerman, Hoboken, NJ (US)

(73) Assignee: JIA WEI LIFESTYLE, INC., Montclair, NJ (US)

( * ) Notice: Subject to any disclaimer, the term of this patent is extended or adjusted under 35 U.S.C. 154(b) by 0 days.

(21) Appl. No.: 18/981,850

(22) Filed: Dec. 16, 2024

(65) Prior Publication Data

US 2026/0167375 A1 Jun. 18, 2026

(51) Int. Cl.
*B65D 1/10* (2006.01)
*B65D 1/40* (2006.01)
(Continued)

(52) U.S. Cl.
CPC ..... *B65D 1/10* (2013.01); *B65D 1/40* (2013.01); *B65D 41/04* (2013.01); *B65D 53/02* (2013.01); *B65D 81/3216* (2013.01)

(58) Field of Classification Search
CPC .. B65D 1/04; B65D 21/0237; B65D 81/3216; B65D 1/10; B65D 1/40; B65D 41/04; B65D 53/02
See application file for complete search history.

(56) References Cited

U.S. PATENT DOCUMENTS 3,732,999 A * 5/1973 Rounkles ..... B65D 1/04 426/120
8,662,305 B2 * 3/2014 Sung ..... B65D 11/188 206/499
(Continued)

FOREIGN PATENT DOCUMENTS

CN 107890297 A 4/2018
JP 3105327 U 10/1991
(Continued)

OTHER PUBLICATIONS

Review of Sushi Making Kit for Beginners—Sushi Bazooka Sushi Maker., YouTube, Dec. 16, 2023, Retrieved from https://www.youtube.com/shorts/IPmqkORMszQ.
(Continued)

*Primary Examiner* — Shawn M Braden
(74) *Attorney, Agent, or Firm* — MUNCY, GEISSLER, OLDS & LOWE, P.C.

(57) ABSTRACT

A food container includes a body unit and a cap. The body unit extends along a first direction, and includes a body member and a body cover that are arranged along a second direction transverse to the first direction and that are interconnected. The body member defines a mouth portion opening that opens in the first direction, and a body opening that opens in the second direction. The body cover is separably disposed on the body member to cover the body opening. The body member and the body cover cooperatively define an internal space. The cap is separably disposed on the body member to cover the mouth portion opening.

14 Claims, 8 Drawing Sheets

(51) Int. Cl.

| | |
|---|---|
| ***B65D 41/04*** | (2006.01) |
| ***B65D 53/02*** | (2006.01) |
| ***B65D 81/32*** | (2006.01) |

(56) References Cited

U.S. PATENT DOCUMENTS

| | | | | |
|---|---|---|---|---|
| D1,006,545 | S | 12/2023 | You | |
| 2008/0142520 | A1* | 6/2008 | Morgan | A45F 3/16<br>220/254.3 |
| 2008/0296246 | A1* | 12/2008 | Chow | B65D 81/32<br>215/6 |
| 2008/0302803 | A1* | 12/2008 | Yacko | B65D 21/0237<br>220/660 |
| 2011/0101004 | A1 | 5/2011 | Spirk et al. | |
| 2014/0374370 | A1* | 12/2014 | Nowzari | B65B 5/06<br>53/474 |

FOREIGN PATENT DOCUMENTS

| | | | |
|---|---|---|---|
| JP | 3118788 | U | 2/2006 |
| JP | 2016504242 | A | 2/2016 |
| KR | 102182914 | B | 11/2020 |

OTHER PUBLICATIONS

Examination Report issued to Australian counterpart application No. 2025204173 by the IP Australia on Feb. 27, 2026.

* cited by examiner

FOOD CONTAINER

FIELD

The disclosure relates to a container, and more particularly to a food container that is adapted for pickling, storing or containing food such as salad.

BACKGROUND

Referring to FIG. 1, a conventional food container, which is commonly known as a mason jar, includes a bottle body 11 made of a transparent glass material, and a bottle cap 12 separably covering the bottle body 11. Since the bottle body 11 is made of a transparent glass material, food (such as drinks or pickles) contained therein can be clearly seen, which increases appetite. However, since a bottle mouth of the conventional food container is not large enough, and since the bottle mouth is away from a bottom portion of the conventional food container, it is difficult for a user to access food (such as salad) in the conventional food container, especially food in the bottom portion thereof. Thus, such conventional food container is inconvenient in use. Furthermore, the conventional food container cannot separate salad ingredients from salad dressing; thus, the salad dressing has to be mixed with the salad ingredients when being contained in the conventional food container. However, if the salad ingredients contact the salad dressing for a long time, the salad ingredients become not crispy anymore. Due to the drawbacks mentioned above, the conventional food container should be further improved.

SUMMARY

Therefore, an object of the disclosure is to provide a food container that can alleviate at least one of the drawbacks of the prior art.

According to the disclosure, the food container includes a body unit and a cap. The body unit extends along a first direction, and includes a body member and a body cover that are arranged along a second direction transverse to the first direction and that are interconnected. The body member defines a mouth portion opening that opens in the first direction, and a body opening that opens in the second direction. The body cover is separably disposed on the body member to cover the body opening. The body member and the body cover cooperatively define an internal space. The cap is separably disposed on the body member to cover the mouth portion opening.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
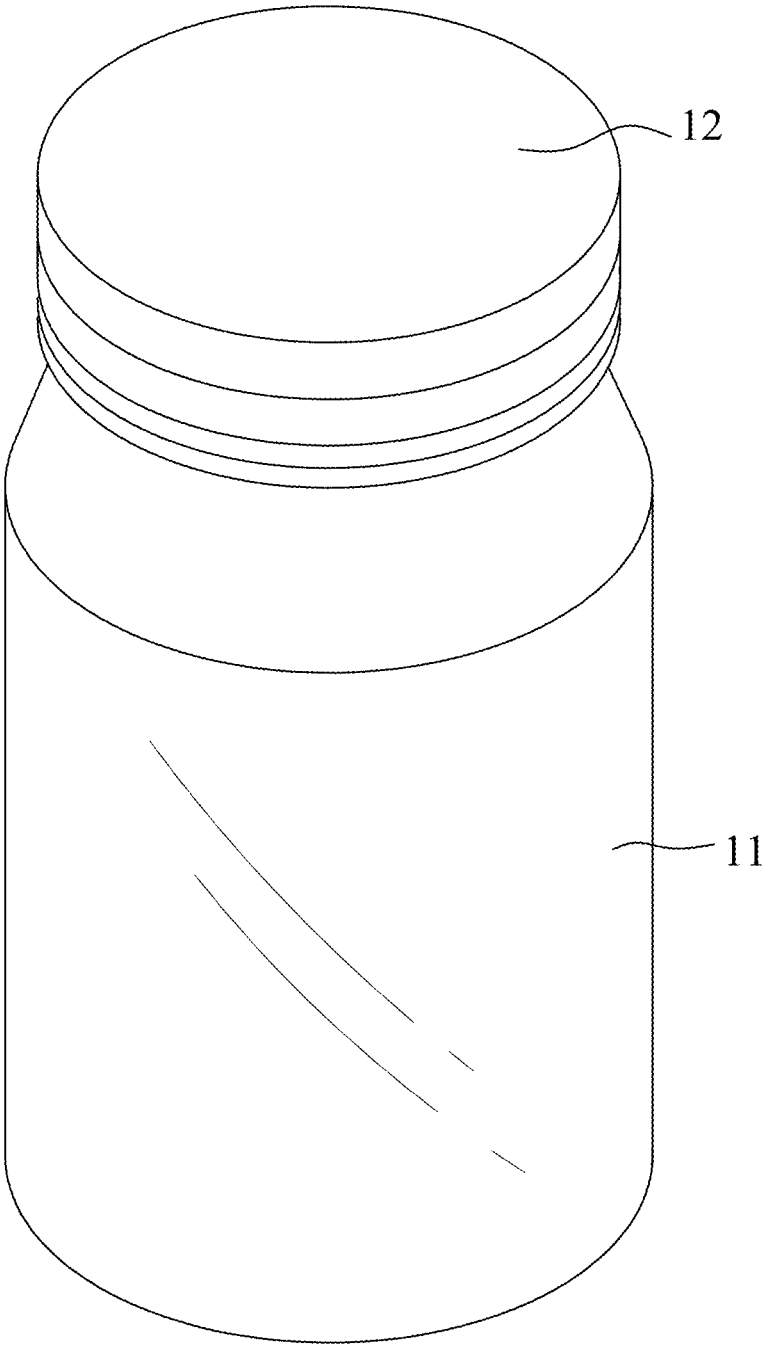
FIG. 1 PRIOR ART
FIG. 1 is a perspective view of a conventional food container.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
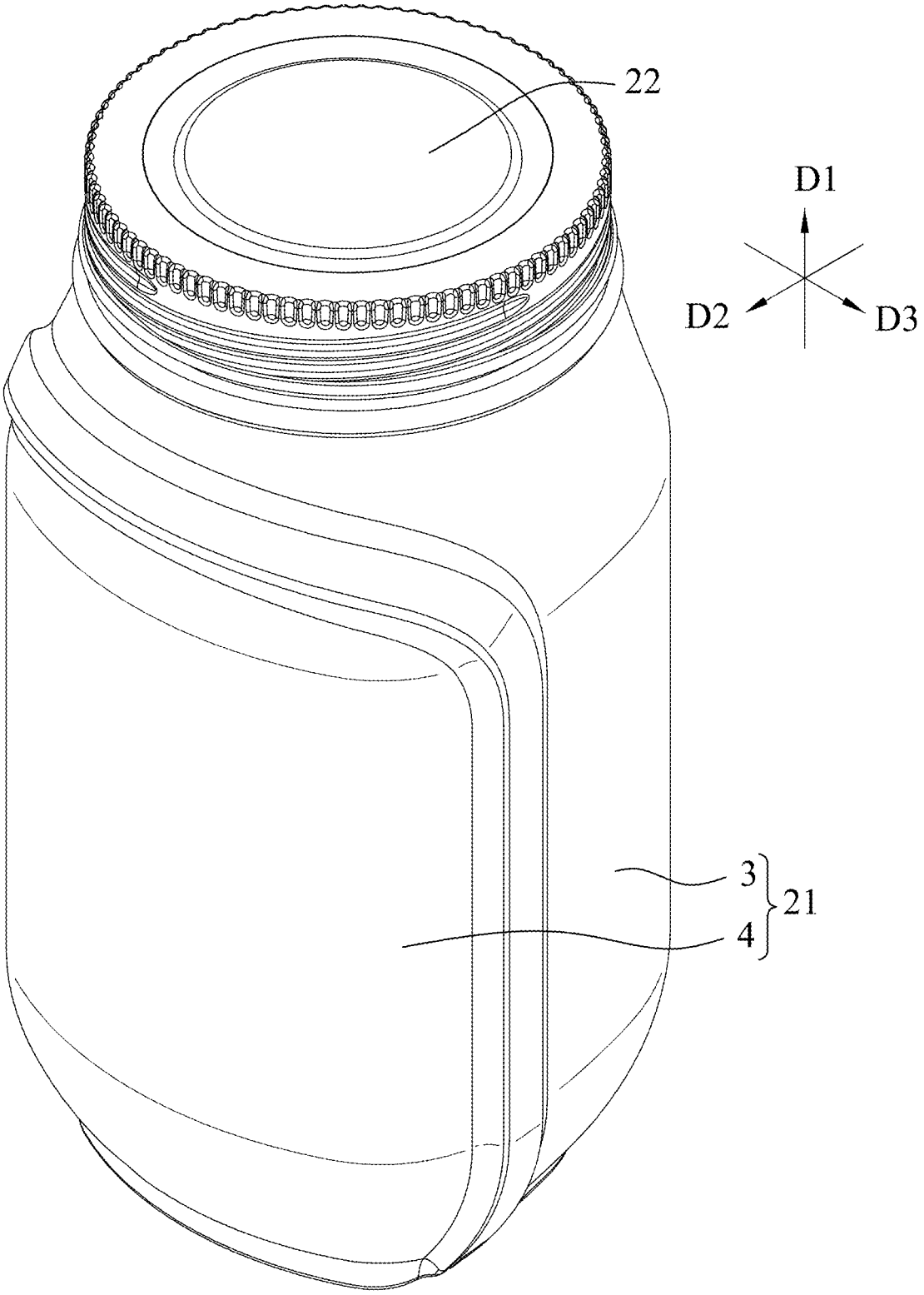
FIG. 2 is a perspective view, illustrating an embodiment of a food container of the disclosure being set upright.
Figure 3:
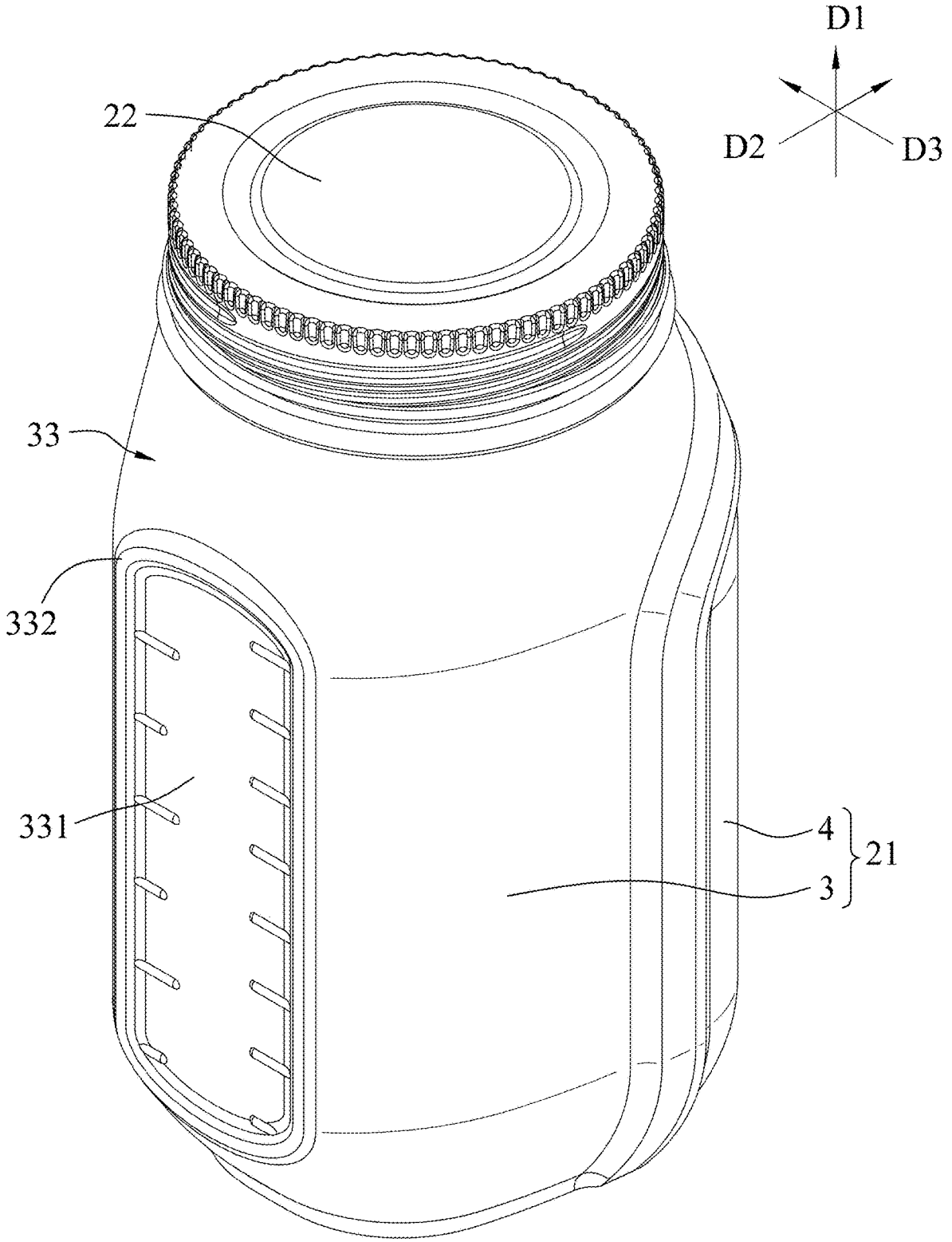
FIG. 3 is a perspective view of the embodiment viewed from another angle.
Figure 4:
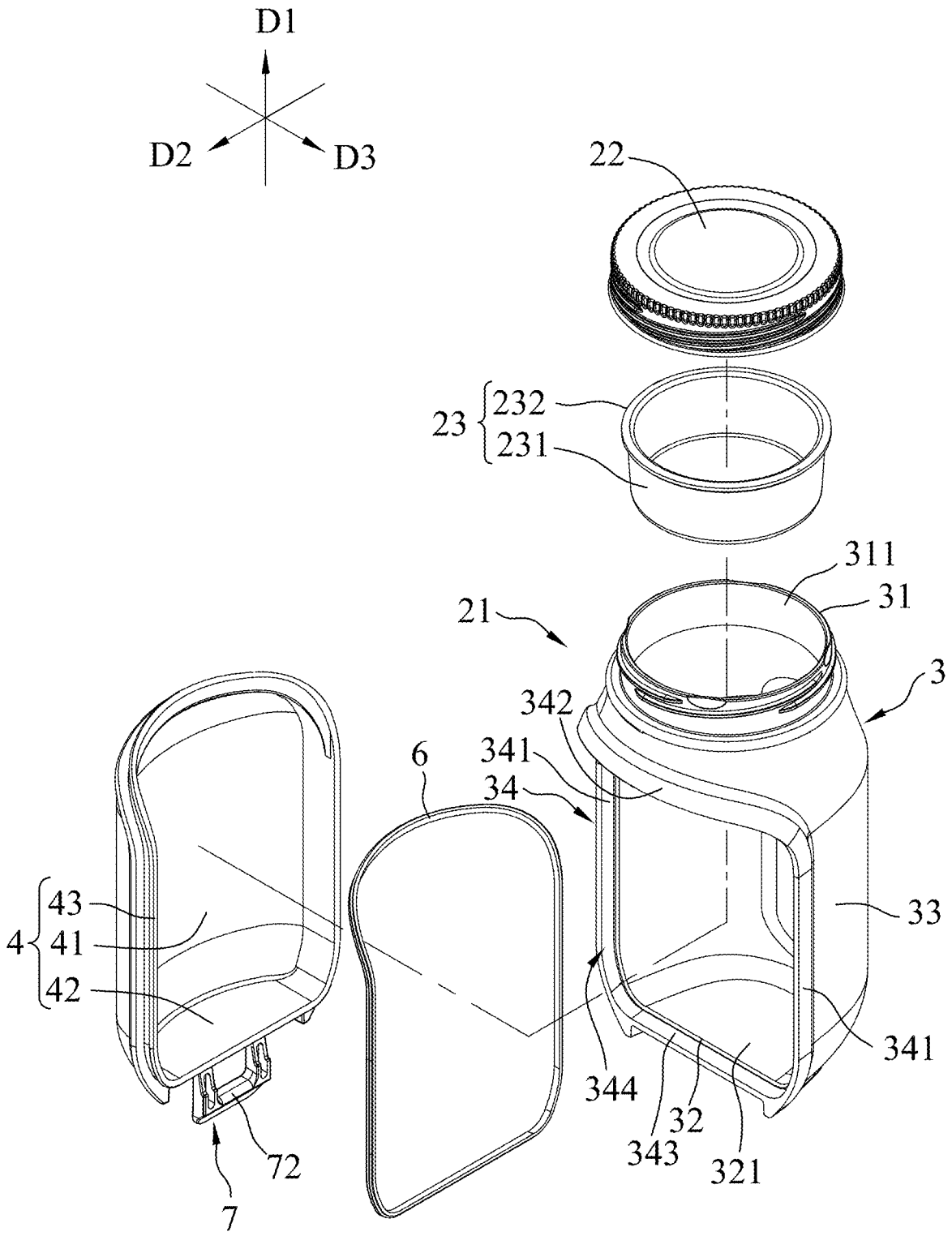
FIG. 4 is an exploded perspective view of the embodiment.

Referring to FIGS. 2 to 4, an embodiment of a food container according to the disclosure is adapted for containing various food ingredients and dishes, such as dressing and ingredients of salad. The ingredients may include shredded lettuces, sliced fruits and vegetables, chopped nuts, or meat (shredded meat, cubed meat, sliced meat, etc.). The dressing may be, for example, Thousand Island dressing or Caesar salad dressing.

The embodiment includes a body unit 21, a cap 22 that covers a top end of the body unit 21, and a compartment member 23 that is disposed between the body unit 21 and the cap 22.

Figure 5:
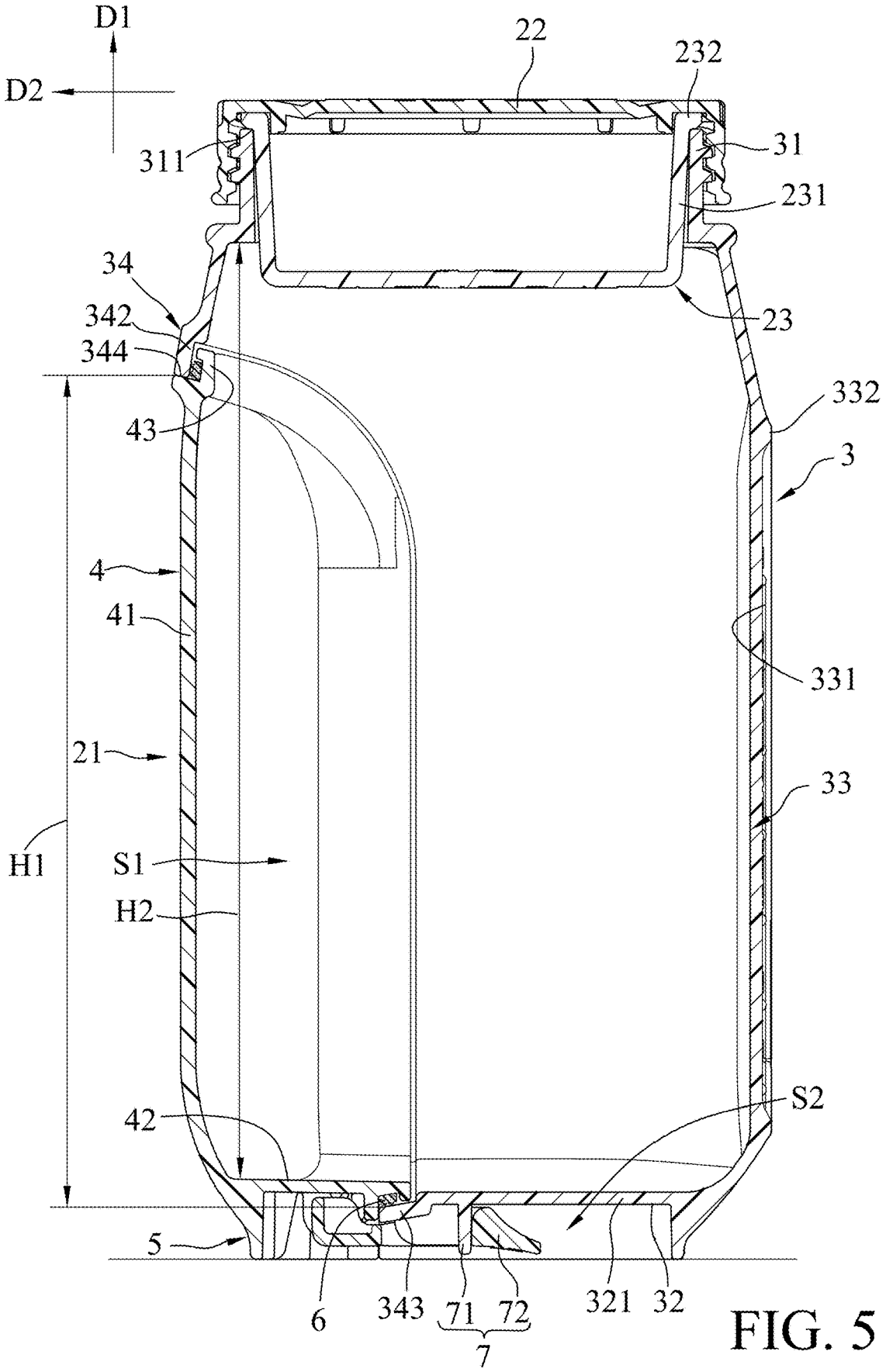
FIG. 5 is a side sectional view of the embodiment.

Referring to FIGS. 3 to 5, the body unit 21 extends along a first direction (D1), and includes a body member 3 and a body cover 4 that are arranged along a second direction (D2) transverse to the first direction (D1) and that are interconnected, a bottom annular protrusion 5 that is formed on the body member 3 and the body cover 4, a seal strip 6 that is disposed between the body member 3 and the body cover 4, and an engagement unit 7 that is used to secure the body member 3 and the body cover 4 together. In this embodiment, the first direction (D1) is a top-bottom direction and the second direction (D2) is a front-rear direction, but the disclosure is not limited thereto.

In this embodiment, the body member 3 is made of a transparent plastic material (e.g. Tritan), and the body cover 4 is made of a transparent plastic material (e.g. Tritan); however, in other embodiments of the disclosure, the body member 3 may be made of a material that is transparent, translucent, or opaque (such as glass), and the body cover 4 may be made of a material that is transparent, translucent, or opaque (such as glass).

The body member 3 and the body cover 4 cooperatively define an internal space (S1). The body member 3 has a mouth portion 31 and a bottom portion 32 that are disposed respectively on top and bottom sides of the body member 3 in the first direction (D1), a main portion 33 that are connected between the mouth portion 31 and the bottom portion 32. The bottom portion 32 and the main portion 33 cooperatively define a first surround edge 34 (see FIG. 8).

The mouth portion 31 is annular in shape, and has an outer surface that is formed with an external thread, and an inner surface that defines a mouth portion opening 311 opening in the first direction (D1).

The bottom portion 32 is opposite to the mouth portion opening 311, and includes a first bottom wall 321 that extends in the second direction (D2).

The main portion 33 has a flat side surface 331 that is located at a rear side of the main portion 33, and a body annular protrusion 332 that surrounds the flat side surface 331. The flat side surface 331 is labeled with a capacity scale. The body unit 21 is able to be disposed on a support plane (not shown) through the body annular protrusion 332; that is, the embodiment is laid down (see FIG. 8).

Figure 6:
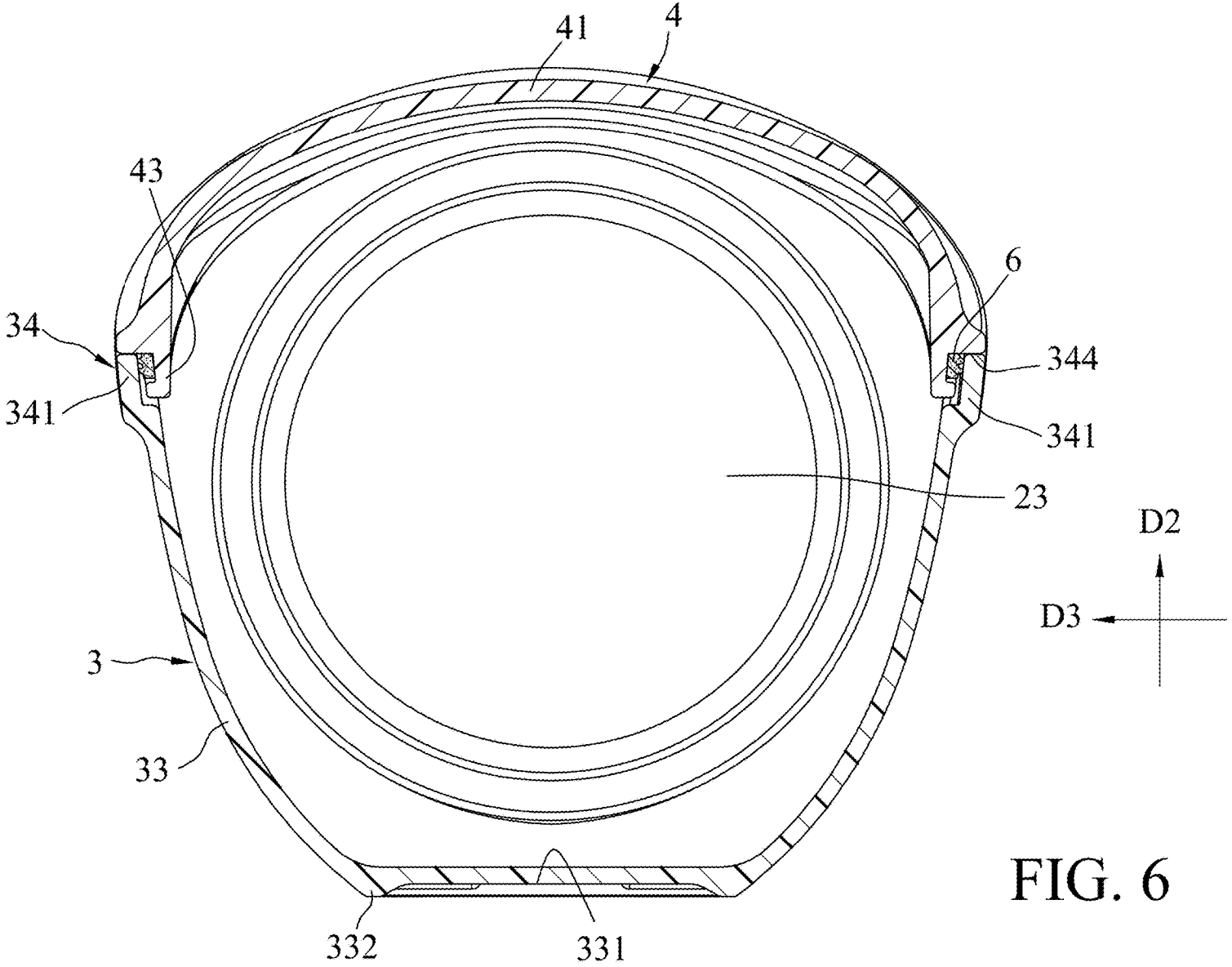
FIG. 6 is a bottom sectional view of the embodiment.

Referring to FIGS. 4 to 6, the first surround edge 34 has two side edge segments 341 that are spaced apart from each other in a third direction (D3) and that substantially extend in the first direction (D1), and a top edge segment 342 and a bottom edge segment 343 that are spaced apart from each other in the first direction (D1) and that are connected between the side edge segments 341. In this embodiment, the third direction (D3) is a left-right direction transverse to the first direction (D1) and the second direction (D2), but the disclosure is not limited thereto. The top edge segment 342 extends forwardly and curvedly to be connected between top ends of the side edge segments 341, and the bottom edge segment 343 extends parallel to the third direction (D3) to be connected between bottom ends of the side edge segments 341.

The first surround edge 34 defines a body opening 344; specifically, the side edge segments 341, the top edge segment 342 and the bottom edge segment 343 cooperatively define the body opening 344 that opens in the second direction (D2), and that is opposite to the body annular protrusion 332. The body opening 344 extends upwardly from the bottom portion 32 to be located below and spaced apart from the mouth portion opening 311 in the first direction (D1). An area of the body opening 344 is greater than an area of the mouth portion opening 311. Referring to FIG. 5, an extent (H1) of the body opening 344 in the first direction (D1) is greater than half of an extent (H2) of the internal space (S1) in the first direction (D1). Specifically, the extent (H1) of the body opening 344 in the first direction (D1) may be 70% to 90% of the extent (H2) of the internal space (S1) in the first direction (D1), such as 75%, 80% or 85%.

The body cover 4 is separably disposed on the body member 3 to cover the body opening 344. When the body cover 4 covers the body opening 344, the body member 3 and the body cover 4 cooperatively define the internal space (S1).

The body cover 4 has a cover wall 41 that is substantially in a shape of a carapace of a turtle, a second bottom wall 42 that is connected to the cover wall 41, and a second surround edge 43 that protrudes from the cover wall 41 and the second bottom wall 42 towards the body member 3.

The second surround edge 43 is located at an inner side of the first surround edge 34. Specifically, in this embodiment, compared to the first surround edge 34, the second surround edge 43 is more adjacent to the internal space (S1). In some embodiments, the first surround edge 34 surrounds the second surround edge 43.

The bottom annular protrusion 5 extends on the first bottom wall 321 of the body member 3 and the second bottom wall 42 of the body cover 4 in an annular manner. The body member 3 and the body cover 4 cooperatively define a bottom space (S2); specifically, the first bottom wall 321, the second bottom wall 42 and the bottom annular protrusion 5 cooperatively define the bottom space (S2) that recesses towards the internal space (S1) in the first direction (D1).

The seal strip 6 is made of silicone rubber and is sleeved on and arrested by the second surround edge 43 of the body cover 4; the seal strip 6 is located between and abuts against the first surround edge 34 and the second surround edge 43, so as to prevent food leaking from the internal space (S1) through a gap between the first surround edge 34 and the second surround edge 43 when the body cover 4 covers the body opening 344.

Figure 7:
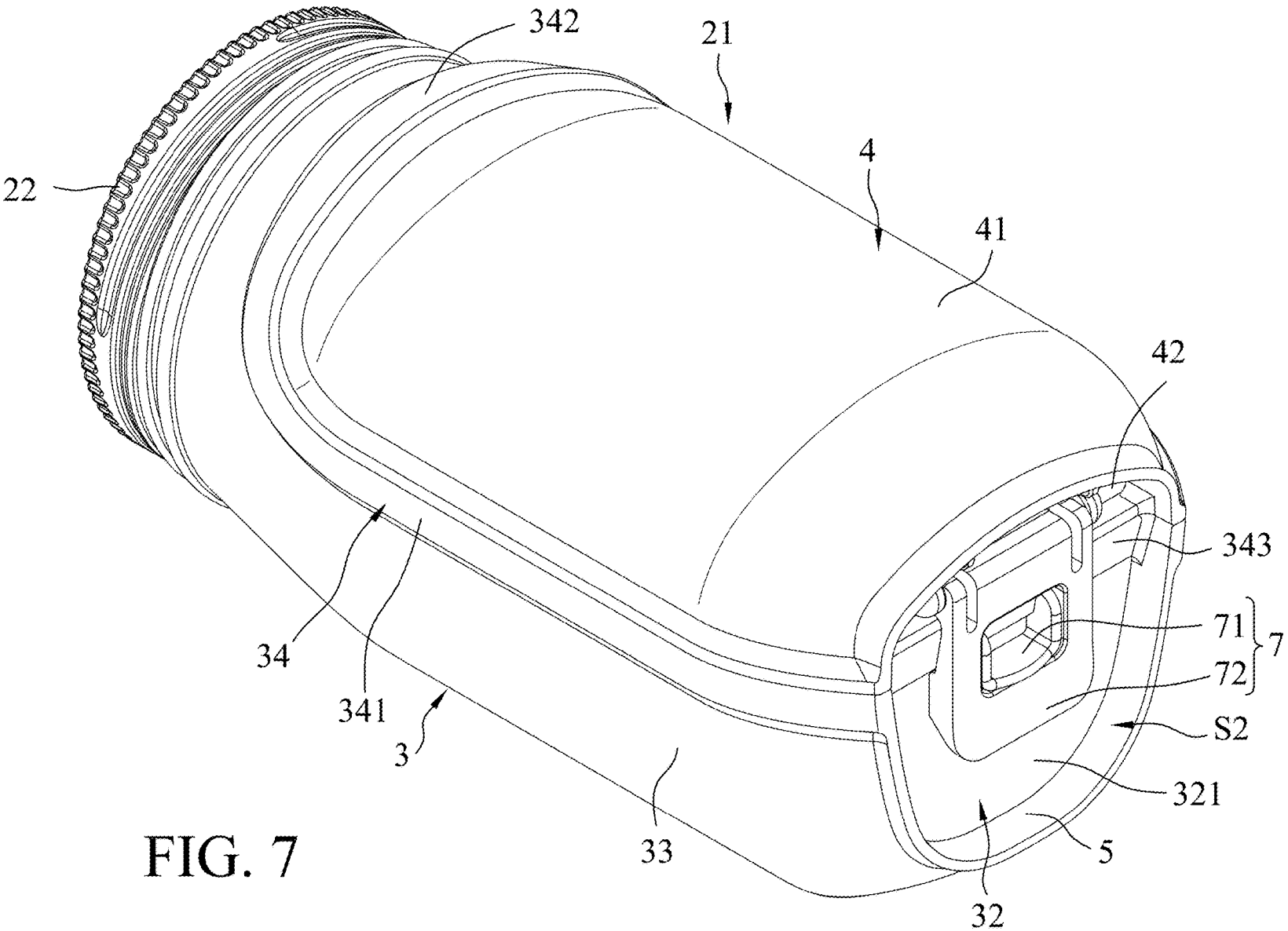
FIG. 7 is a perspective view of the embodiment being laid down.
Figure 8:
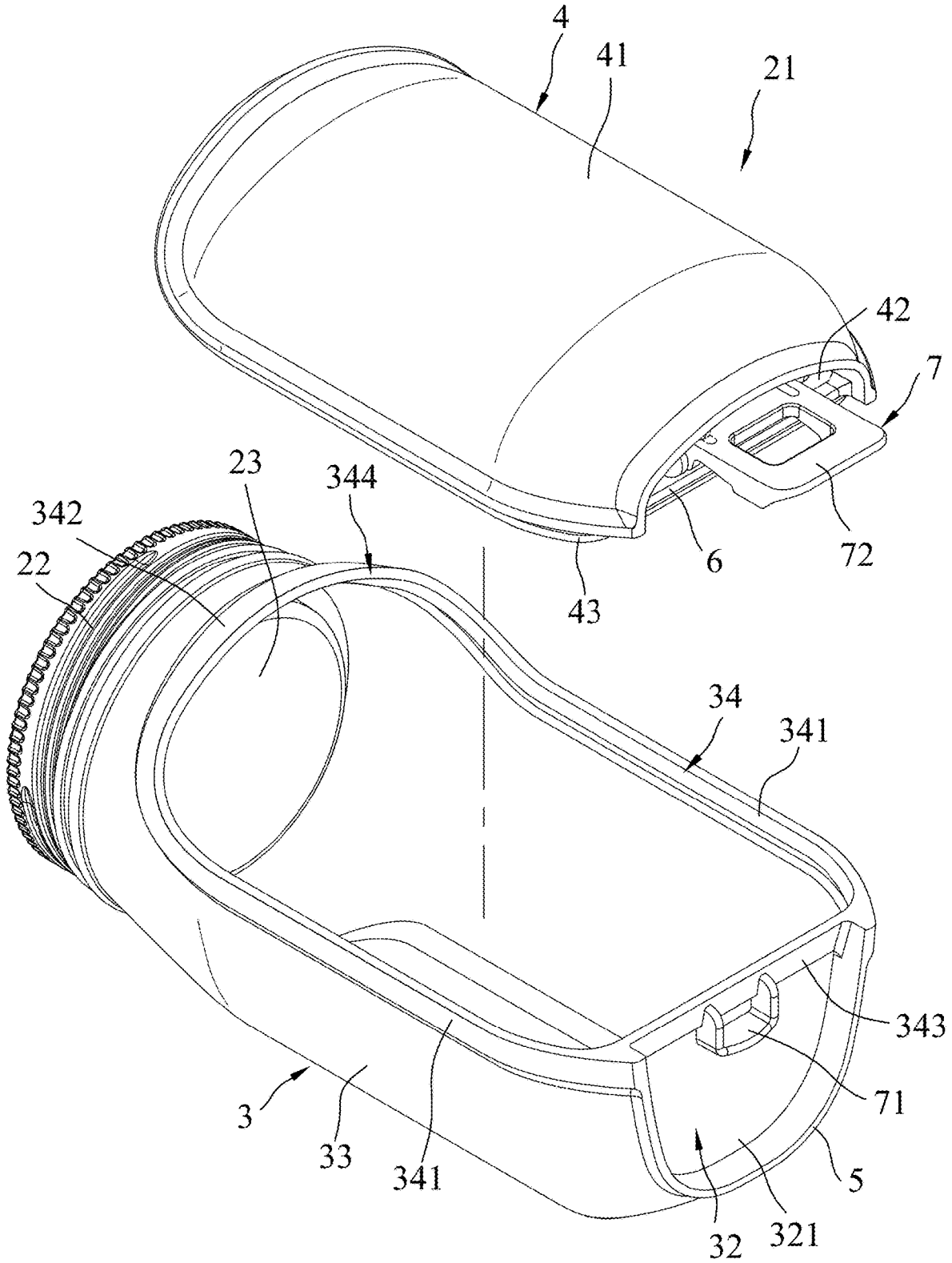
FIG. 8 is a partially exploded perspective view of the embodiment, illustrating a body cover being apart from a body member and a body opening being exposed.

Referring to FIGS. 5, 7 and 8, the engagement unit 7 is made of a plastic material, such as polypropylene, and is located in the bottom space (S2). The engagement unit 7 includes an engagement ring 72 that is pivotally connected to one of the body member 3 and the body cover 4, and an engagement member 71 that is disposed on the other one of the body member 3 and the body cover 4. Specifically, in this embodiment, the engagement ring 72 is pivotally connected to the second bottom wall 42 of the body cover 4, and the engagement member 71 is disposed on the first bottom wall 321 of the body member 3, but the disclosure is not limited to such.

The engagement member 71 is U-shaped and opens towards the second bottom wall 42, and the engagement ring 72 is substantially in a shape of a square ring; a user may press the engagement ring 72 towards the first bottom wall 321, in order to let the engagement member 71 to forcibly enter a hole of the engagement ring 72 and engage the engagement ring 72, such that the body member 3 and the body cover 4 are secured to each other.

Referring to FIGS. 4 and 5, the cap 22 is made of a plastic material, such as polypropylene. The cap 22 is separably and threadedly attached to the mouth portion 31 of the body member 3 to cover the mouth portion opening 311 and the compartment member 23.

The compartment member 23 is made of a plastic material, such as polypropylene, and includes a main body 231 that is cylindrical in shape, and a flange 232 that is annular in shape and that surrounds a top end of the main body 231; specifically, the flange 232 extends radially and outwardly from the top end of the main body 231, and is configured to abut against a top end of the mouth portion 31. In use, the compartment member 23 may be disposed in the mouth portion 31; that is, through the abutment between the flange 232 and the top end of the mouth portion 31, the main body 231 may extend into and be contained in the mouth portion opening 311.

Referring to FIGS. 2, 7 and 8, the embodiment may be set upright (see FIG. 2) or laid down (see FIG. 7).

Referring to FIGS. 2 and 5, when the embodiment is set upright, the bottom annular protrusion 5 is located lowermost and contacts the support plane, and the cap 22 faces upwards. Referring to FIGS. 7 and 8, when the embodiment is laid down, the body annular protrusion 332 is located lowermost and contacts the support plane, and the body cover 4 faces upwards.

In use, when the embodiment is set upright, the user may open the cap 22 and remove the compartment member 23, so as to put salad ingredients into the internal space (S1). Then, the compartment member 23 is put back into the mouth portion 31, and the user may pour salad dressing thereinto. After the cap 22 is threadedly attached to the mouth portion 31 and covers the mouth portion opening 311, preparation of a salad is done and the salad ingredients along with the dressing may be carried through the embodiment.

When a user is going to have a salad, the user opens the cap 22 (i.e., separates the cap 22 from the mouth portion 31), takes the compartment member 23 out and tightens the cap 22 in a condition where the embodiment is set straight. Then, as shown in FIGS. 7 and 8, the embodiment is laid down, and the user may pull the engagement ring 72 relative to the body cover 4, such that the engagement ring 72 is detached from the engagement member 71, and the user may separate the body cover 4 from the body member 3 as shown in FIG.

8. When the body cover 4 is removed to expose the body opening 344, the body member 3 may serve as a salad bowl. After this, the user can pour the dressing into the internal space (S1) so that the salad is served.

Features and advantages of the present disclosure are summarized as follows.

The body opening 344 is more adjacent to the bottom portion 32 than the mouth portion opening 311; thus, it is more convenient for the user to access all portions of the internal space (S1) through the body opening 344. In addition, the extent (H1) of the body opening 344 in the first direction (D1) may be 70% to 90% of the extent (H2) of the internal space (S1) in the first direction (D1), which ensures that a size of the body opening 344 is large enough for the user to conveniently access food contained in the internal space (S1) through the body opening 344.

In addition to conveniently accessing the food contained in the internal space (S1), the size of the body opening 344 facilitates cleaning of the body member 3; that is, by virtue of the size of the body opening 344 being large enough, it is easier for the user to reach their hands into the internal space (S1) and there is no blind spot existing in the internal space (S1) for cleaning.

By virtue of the body annular protrusion 332 and the bottom annular protrusion 5, the body unit 21 may be either set upright or laid down stably; in corporation with design of the body cover 4 and the body opening 344, the embodiment may function as either a bottle or a bowl and may be operated stably.

The compartment member 23 is designed to contain salad dressing, so that the salad dressing and salad ingredients are separated from each other, preventing the salad ingredients from contacting the salad dressing for a long time, thereby ensuring freshness and taste of the salad ingredients.

In summary, the effect of the disclosure lies in that by virtue of the configuration of the body opening 344, the user may access food contained in the internal space (S1) more easily.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A food container, comprising:

a body unit extending along a first direction, and including a body member and a body cover that are arranged along a second direction transverse to the first direction and that are interconnected, said body member defining a mouth portion opening that opens in the first direction, and a body opening that opens in the second direction, said body cover being separably disposed on said body member to cover said body opening, said body member and said body cover cooperatively defining an internal space; and a cap separably disposed on said body member to cover said mouth portion opening, wherein said body opening, said mouth portion opening and said internal space are in spatial communication with each other.

2. The food container as claimed in claim 1, wherein said body unit further includes an engagement unit that secures said body member and said body cover together.

3. The food container as claimed in claim 2, wherein said body member and said body cover cooperatively define a bottom space that recesses towards said internal space in the first direction, said engagement unit being located in said bottom space.

4. The food container as claimed in claim 3, wherein said engagement unit includes an engagement ring that is pivotally connected to one of said body member and said body cover, and an engagement member that is disposed on another one of said body member and said body cover.

5. The food container as claimed in claim 2, wherein said engagement unit includes an engagement ring that is pivotally connected to one of said body member and said body cover, and an engagement member that is disposed on another one of said body member and said body cover.

6. The food container as claimed in claim 1, wherein said body member has a mouth portion that is annular in shape and that defines said mouth portion opening, said cap being separably disposed on said mouth portion of said body member, said food container further comprising a compartment member that is disposed in said mouth portion.

7. The food container as claimed in claim 6, wherein said cap is separably disposed on said mouth portion to cover said mouth portion opening and to secure said compartment member to said mouth portion.

8. The food container as claimed in claim 1, wherein said body member has a first surround edge that defines said body opening, said body cover having a second surround edge that is located at an inner side of said first surround edge.

9. The food container as claimed in claim 8, wherein said body unit further includes a seal strip that is located between and abuts against said first surround edge and said second surround edge.

10. The food container as claimed in claim 1, wherein an area of said body opening is greater than an area of said mouth portion opening.

11. The food container as claimed in claim 10, wherein said body member has a bottom portion that is disposed opposite to said mouth portion opening, said body opening extending from said bottom portion to be located below and spaced apart from said mouth portion opening in the first direction.

12. The food container as claimed in claim 1, wherein said body member has a bottom portion that is disposed opposite to said mouth portion opening, said body opening extending from said bottom portion to be located below and spaced apart from said mouth portion opening in the first direction.

13. The food container as claimed in claim 1, wherein said body member has a body annular protrusion that is opposite to said body opening, said body annular protrusion being able to abut against a support plane so that said body unit is disposed on the support plane.

14. A food container, comprising:

a body unit including a body member and a body cover, said body member defining a mouth portion opening that opens in a first direction, and a body opening that opens in a second direction transverse to the first direction, said body cover being separably disposed on said body member to cover said body opening, said body member and said body cover cooperatively defining an internal space; and a cap separably disposed on said body member to cover said mouth portion opening, wherein said body opening, said mouth portion opening and said internal space are in spatial communication with each other.

* * * * *